United States Patent [19]

Patsy

[11] Patent Number: 4,645,210

[45] Date of Patent: Feb. 24, 1987

[54] PROGRAMMABLE MOVING TARGET SOCCER PRACTICE

[76] Inventor: Samuel M. Patsy, P.O. Box 835, Rockville, Md. 20853

[21] Appl. No.: 682,985

[22] Filed: Dec. 18, 1984

[51] Int. Cl.[4] ..... F41J 9/02

[52] U.S. Cl. ..... 273/369; 273/406; 273/411

[58] Field of Search ..... 273/359, 369, 370, 403, 273/404, 406, 407, 410, 411; 211/119.01-119.1

[56] References Cited

U.S. PATENT DOCUMENTS

| | | | |
|---|---|---|---|
| Re. 30,013 | 5/1979 | Knight . | |
| 495,371 | 4/1893 | Rice | 273/369 |
| 2,336,914 | 12/1943 | Anderson | 211/119.02 |
| 2,485,322 | 10/1949 | Schlags | 211/119.09 |
| 2,569,594 | 10/1951 | Aagesen . | |
| 2,793,038 | 5/1957 | Wallace et al. | 273/406 |
| 3,140,874 | 7/1964 | Jensen et al. | 273/369 |
| 3,471,153 | 10/1969 | Baumler | 273/359 |
| 3,728,480 | 4/1973 | Baer . | |
| 3,914,879 | 10/1975 | Taylor, III et al. . | |
| 4,072,313 | 2/1978 | Murso et al. . | |
| 4,076,247 | 2/1978 | Kim et al. . | |
| 4,092,023 | 5/1978 | Hazen . | |
| 4,103,892 | 8/1978 | Hinze . | |
| 4,222,564 | 9/1980 | Allen et al. . | |

*Primary Examiner*—Leo P. Picard

*Attorney, Agent, or Firm*—Hall, Myers & Rose

[57] ABSTRACT

The apparatus provides a moving target for practicing perceptual and perceptual motor skills particularly for education, therapy, athletics and amusement. The moving target may be large or small at ground level or above ground level and may be propelled at various different speeds in opposite directions. The interval of movement in a given direction is variable selectively or randomly as is the pause time between intervals of movement and speed. The movement of the target permits the practice for training and increasing motor skills, adaptability and attentiveness to time, distance, direction and force at all levels of skill.

26 Claims, 22 Drawing Figures

PROGRAMMABLE MOVING TARGET SOCCER PRACTICE

TECHNICAL FIELD

The present invention relates generally to training devices and specifically to devices for training and improving perceptual skills and perceptual motor skills.

More particularly the invention relates to moving target devices with automatic or manual direction and speed controls for training and improving perceptual skills and perceptual motor skills.

BACKGROUND OF THE INVENTION

Fundamental to the ideal development of a child or young adult is an ability to perceive and react to his or her surroundings. Parents and teachers monitor the development of a child by observing the child's ability to perceive changes in the environment and suitably respond or adapt to the changes. For example, one of the noted milestones in the early stages of infancy occurs when the infant develops the ability to follow a person or an object with the eyes.

It is not uncommon that a normally developed individual becomes involved in some catastrophic event which necessitates that these fundamental skills be relearned. Therapy, often prolonged and difficult, is necessary for the individual to resume his/her place in society. Examples of such persons include victims of automobile accidents and wounded veterans. In these situations rehabilitation is necessary. In some instances the individual will never return fully to their former capacities. This then, involves a reeducation of the individual such that with their limitations, they can be most effective in coping with their environment and lead a fruitful life. Other individuals, handicapped or possessing subnormal or underdeveloped perceptual motor skills represent a significant segment of our community. A need exists for training aids that will facilitate the learning process in these situations.

Although several unique disciplines merit consideration; childhood development, handicapped and rehabilitation therapy, sports, and recreation all have the same foundation in motor skills. The principles of teaching motor skills remains the same; the application of these principles can be quite diverse. Researchers state that to teach perceptual and perceptual motor skills the learner must start slowly, develop a skill level, then move on to the next level of proficiency. As an individual's proficiency increases, the training must include increasingly difficult teaching exercises. Once a high performance level is achieved, the individual requires constant practice to maintain this high skill level.

Thus a device for teaching motor skills must be versatile enough to teach the unskilled, stimulate the average individual, and challenge the professional. Specifically, the device must teach the kinesthetic and mechanical factors of motor skills for a particlar discipline to a broad spectrum of skill levels. The device must offer success to every user, regardless of skill level, yet challenge every user to advance to their next higher level of proficiency.

Simple exercises such as pointing and following a moving object, jumping when the object moves and standing still when it stops, or performing certain directed activities linked to the behavior of an object, assist in the development of motor skills, adaptability and attentiveness.

Depth perception, peripheral vision and hearing capacities may also be improved through various exercises with a moving object having specific attachments. All of these skills are necessary for proper development and leading an active normal life.

Motor skills are divided into three factors; kinesthetic, mechanical and motivational. The kinesthetic factor involves the cognitive awareness of the temporal-spatial relationship of time, force and space, more commonly known as the "feel" or "touch" of an object. Time relates to a continuum from slow to fast. Force relates to a continuum from slight to heavy; referred to as degree or intensity. Space has two continuums, level and range. Level is either high or low; range is either short or long.

The mechanical factors involve speed, accuracy, form and adaptability. Researchers explain that there is significant difference in brain activity while performing the same activity but at different speeds. The speed of the activity determines which "neural programs" will be called into action. Accuracy is a classic measure of success. Again, it is known that a considerable difference exists in the muscle tone required for an accurate kick or pass as opposed to a powerful kick or pass. Form relates to economy of effort and has two implications: one is a more relaxed, smoother performance and is referred to as "finesse." In the other, the individual devotes less time to the action itself, allowing him to become more observant of environmental queues and is able to respond to those queues. Adaptability relates to this capacity to perform an activity in a changing environment.

In order to teach skills, a third set of factors are necessary; namely, motivational factors. The motivational factors consist of attentiveness, incentive for improvement, measurement of improvement and feedback or knowledge of results.

Attentiveness requires an individual to devote his undivided attention to the training activity. As to incentive, there must be some challenge to the individual to advance to the next level of proficiency. Measurement of performance requires that there be some method of determining improvement in performance. Feedback in the context of the present invention relates to imparting to the individual knowledge of the results. This knowledge is considered by researchers in motor skills to be the single most important factor in learning.

As stated, the factors of perceptual and perceptual motor skills span a broad spectrum of disciplines. (These include such fundamentals as walking and stopping to fine motor control such as propelling an object through a fast moving target). These include child development, therapy, rehabilitation, research, special education, athletics and amusement.

The following exemplifies various applications of perceptual motor and motor skills in various disciplines.

In early childhood pattern recognition, time-space relationship, three dimensional motion, depth perception, hand-eye control, walking motion patterns, stop/-start motion, and attentiveness training are developed.

Therapy and rehabilitation often include visual training, pacing studies, directional changes, non-locomotor patterns, locomotor patterns, visual tracking, word recognition and impulse control measured motor response for walking and limb movement, coordination exercises, visual training, attention span exercises, queued exercises and treating depth perception problems.

The complexities in motor skills in athletics range from situations where the player is stationary and the ball is stationary, such as golf, to situations where the player moves while the ball or puck is moving as in soccer or hockey. The concepts of movement; performing in a changing environment; the dynamics of motion, with or without a ball are an integral part of most sports. Thus athletics involve; motion patterns for any age group, as well as any skill level, a moving target for any age group or skill level, directional changes, stop/-start patterns and attentiveness training.

SUMMARY OF THE INVENTION

It is therefore an object of the present invention to provide a device directed to developing perceptual and perceptual motor skills.

It is another object of this invention to adapt to various skill levels to increase perceptual and perceptual motor skills.

Still another object of this invention is to develop kinethetic and mechanical abilities associated with motor skills.

Yet another object of this invention is to provide a device for use in a broad range of disciplines including but not limited to education, therapy, rehabilitation, athletics and amusement.

It is another object of this invention to provide a device which is adaptable for use in a variety of environments.

It is yet another object of the present invention to provide a moving target, whose movement patterns can be manually controlled, programmed, or random.

It is still another object of this invention to provide a suitcase-portable target system that can be assembled and disassembled in a minimum of time.

It is another object of this invention to provide a target which may be moved along a predetermined path of variable length.

It is another object of the present invention to provide a dynamic teaching device allowing an individual to practice various skills by himself.

It is another object of this invention to be versatile enough to treat each user as unique.

It is another object of this invention to provide a device capable of quantative measurement of performance.

It still is another object of this invention to provide for a quantative measure of the improvement in performance.

It is another object of this invention to provide a target path that can be any height and/or at any angle.

It is yet another object of the present invention to provide a moving target, whose movement patterns can be programmed, random or manually controlled.

Yet another object of the present invention is to provide a portable target system that can be used indoors or out of doors.

It is another object of the present invention to provide a dynamic teaching device allowing an individual to practice various skills by himself.

It is still another object of this invention to provide a device for teaching of individuals of greatly different perceptual and perceptual motor skills from the handicapped to the professional athlete.

It is another object of this invention to be versatile enough to treat each user as unique.

Still another object of this invention is to be a teaching device for any sport that requires surface passing, such as soccer, ice hockey and field hockey.

Two preferred embodiments of the invention are presented herein. The first embodiment is a below ground level device which moves a target at ground level. The second embodiment takes the concept of the first embodiment and enhances this concept with innovative and unique features that broaden its spectrum of capabilities and its utility. The second embodiment exists because of evaluations of the prototype of the first embodiment.

The first embodiment, the fixed location model is so constructed and arranged that water and dirt are diverted away from all the parts of such structure, whether moving or stationary. In this embodiment of the invention, the moving target is supported on rods extending below abutting surfaces of flexible gaskets, having disposed therebelow a generally curved member, which deflects water, dirt, etc. into unoccupied areas on either side of the target support path and drive. The target is moved by an electric motor.

In the second preferred embodiment, a portable simple, assembly is provided more specifically, the device includes wall brackets which can be permanently mounted, or attached to a one foot 2×2 and attached to a support with a clamp. The wall brackets installed are the only permanently fixed pieces of the device. The wall brackets serve to attach the two sets of pulleys. The brackets have two pins, one projecting from either end. One pin is fixed, the other is spring loaded to facilitate set-up and take-down of the motor end and the passive end. The device includes two sets of pulleys. Each set of pulleys consist of two pulleys aligned one directly over top of the other. The one set of pulleys contains the motor to drive the unit. The motor is connected to a processor unit, which among other items contains the power supply, the processor unit is connected to a hand held controller.

The passive slave unit is simply two pulleys in a mounting assembly. Since there are no electronic, mechanical, or optical switches on passive slave unit, this enables the unit to be mounted anywhere; at any distance from the motor end, any height, and any angle. The physical design of the invention is such that, as the target assembly approaches the end limit, increased current is drawn by the motor, this is sensed within the processor unit and the direction of travel is reversed. A target moves between the motor end and the passive slave end. A cable extends from the top of the target, loops around the top pulley, down a slot behind the master or slave end, around the bottom pulley, back to the bottom of the target, out the other side of the target, to the bottom pulley on the opposite unit, up the back of the unit, over the top pulley and back to the target, where it is attached to a tension indicator.

The cable is spooled within the target in a fashion to permit it to extend to either pulley end. Any length of cable can be withdrawn. This feature allows selection of a target path of any length. Once the cable is withdrawn a tension indicator on the top surface of the target indicates the degree of tension provided by turning as the rachet is connected to the spool to take up the slack in the target path. Target extensions can be mounted to extend above or below the cable. Since the wall brackets can be mounted at any height, this versatility allows for ground level activities, as well as eye level activities, or any combination of heights or angles needed for the activity.

As indicated briefly above, the movement of the target is controlled by a microprocessor which controls the various motions of the target. The microprocessor is housed in a microprocessor unit.

The processor unit and the hand held unit employed in the present invention control the movement of the target. Four modes of operation are provided: tracking mode, program mode, random mode and neutral mode, as well as providing for manual control of the target movement.

In the tracking mode the target moves at the preselected speed and reverses at either end of the target path. It continues this until stopped or another mode is selected.

In the program mode, the run timer and stop timer are brought into operation. In this mode the target runs at the preselected speed for the number of seconds specified in the run timer. After the stop cycle has completed it runs again for the time in the run timer, then stops, etc. The run timer and stop timer range from 1 to 16 seconds. The target will reverse at either end of the target path and then continue its program. The run timer and the stop timer may be changed at any time, as well as changing the speed. In the random mode the speed of the target, the run time, the stop time, and directional changes are chosen by a random number generator circuit. In the neutral mode the target may be stopped for teaching purposes or for working with a stationary target.

The use of this invention can be tailored to suit the needs of an individual or group. Also particularly in the context of competitive sports, multiple devices may be arranged and operated in various manners to simulate specific situations.

These embodiments and others will become obvious to those of ordinary skill in the art from the following detailed description.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings wherein.

DETAILED DESCRIPTION OF THE DRAWINGS

Figure 1:
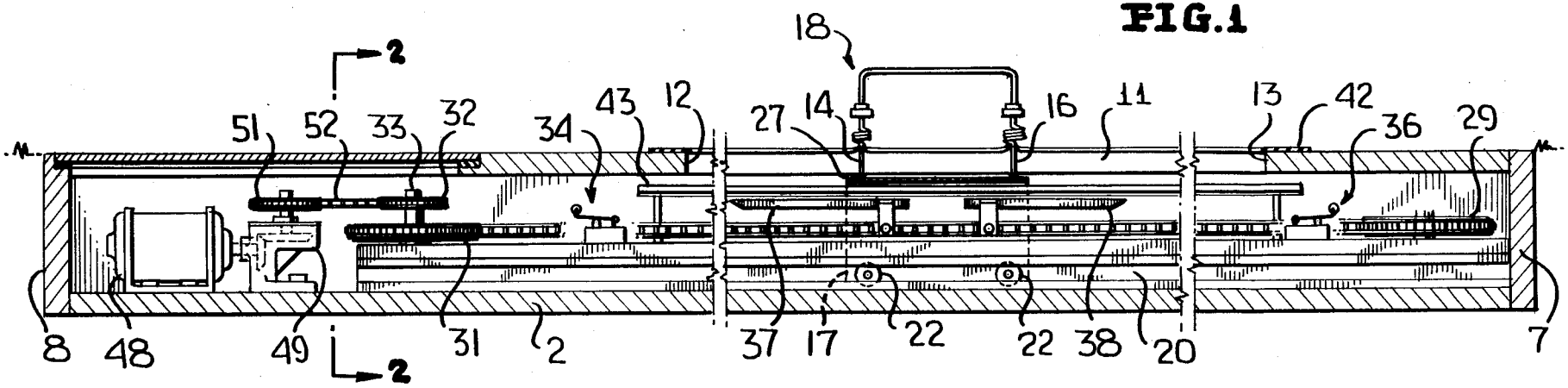
FIG. 1 is a detailed top view of the slide and limit switch arrangement.
Figure 2:
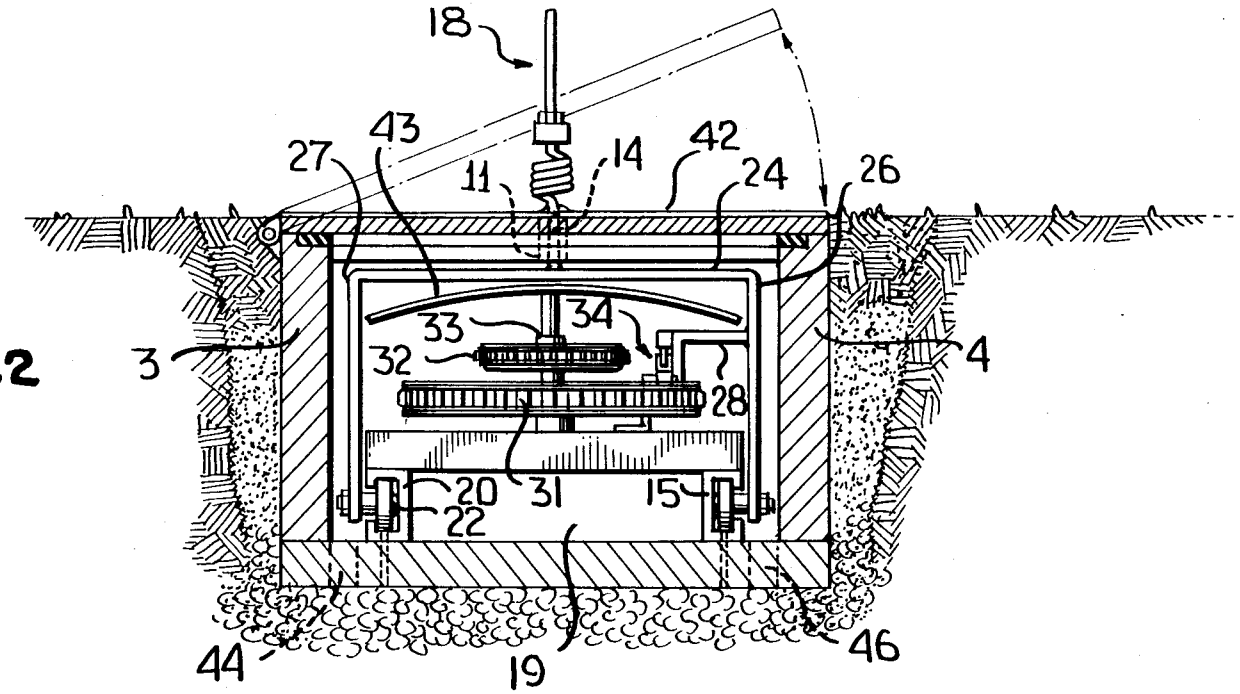
FIG. 2 is an end view taken along section lines 2—2 of FIG. 1.
Figure 3:
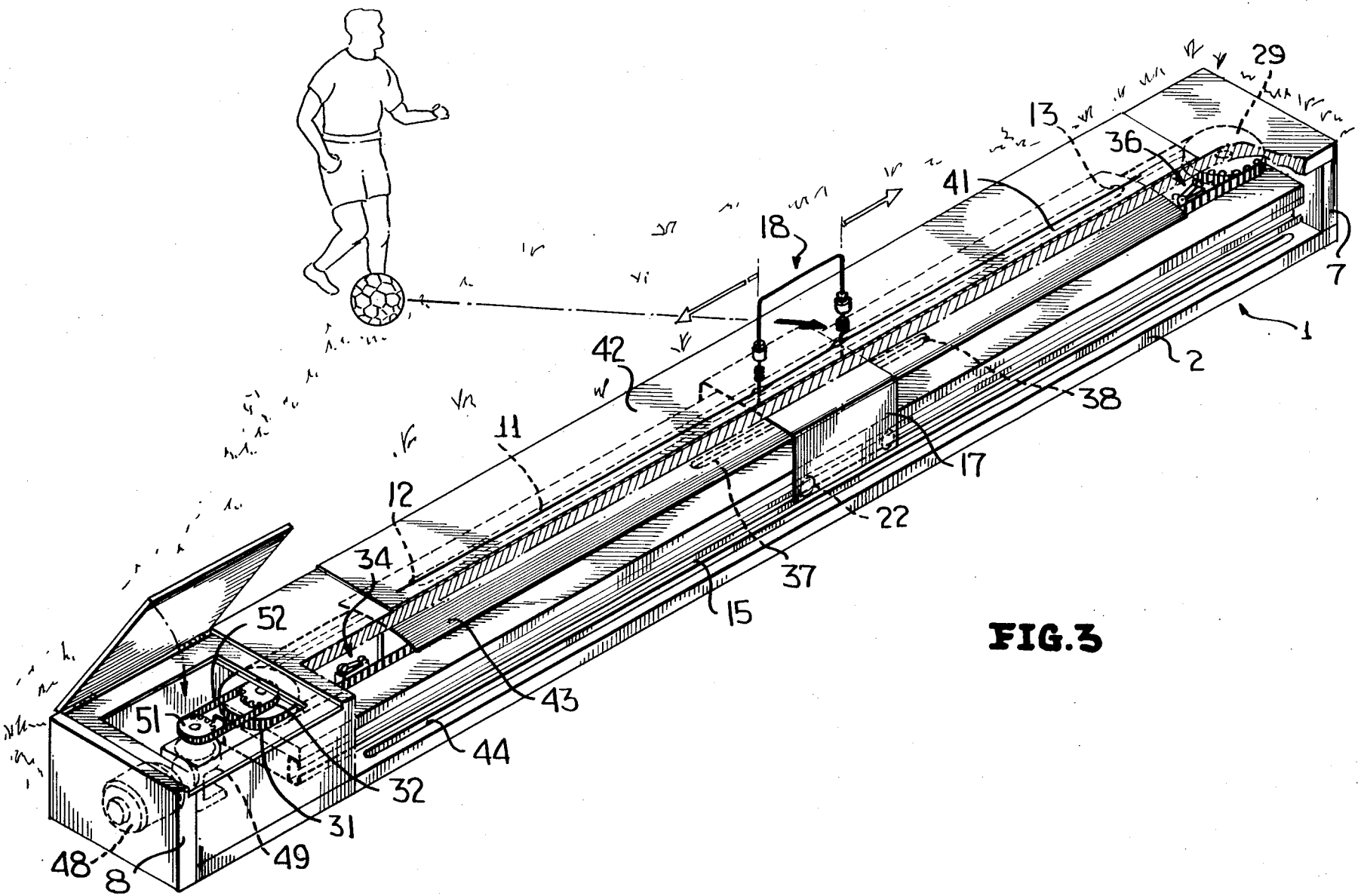
FIG. 3 is a perspective view of the ground implacement arrangement of the apparatus of the present invention.

Referring now specifically to FIGS. 1 through 3, the basic apparatus of the present invention constitutes an elongated generally rectangular box 1, having a bottom wall 2, spaced parallel side walls 3 and 4 and a cover 6. The box 1 normally will be formed as concrete pourings or aluminum since the box can be quite long, running 50 to 100 to even 150 feet or longer. The box 1 also includes end walls 7 and 8 with the end wall 8 having a slot 9 formed therein for purposes to be described subsequently. Also, the top wall 6 has an elongated narrow slot 11 extending between locations 12 and 13. Support members 14 and 16 of a target to be described subsequently extend upwardly from a slide 17 located in the box 1 through the slot 11 to support the target generally designated by the reference numberal 18.

The slide 17 is suitably supported for movement along a stationary support member 19 extending generally the entire length of the box 1. The longitudinally extending sides 15 and 20 of the support 19 are recessed to provide tracks 21 and 22 in sides 15 and 20 to accept rollers 23 rotationally supported on the slide 17. Specifically, slide 17 carries four such rollers 22, two along each side of the slide with the two rollers on each side positioned in its associate track 21 and 22, respectively. In consequence, the slide may move easily along the length of the support 19 with a high degree of stability provided by the four-point sliding or rolling support.

It should be noted that the use of rollers, although perhaps preferable, is not essential since other forms of low friction slide arrangements are available.

Slide 17 is generally an inverted U-shaped member having a top member 24 and side members 26 and 27 to which the rollers 23 are secured. The top member 24 of the U-shaped slide 17 is located just under the cover so that a minimum length of supports 14 and 16 must be provided to position the target 18 above the ground.

The slide 17 is driven by an endless belt 27, the slide being secured to the belt by means of a member 28 connected between the belt 27 and wall 26 of the slide. The endless belt 27 is disposed about two pulleys 29 and 31 located at the right and left ends, as viewed in FIG. 1, of the box 1. The pulley 31 is driven from a further pulley 32 coaxial with the pulley 31 and supported on a common shaft 33.

Limit switches 34 and 36 are provided to sense the position of actuators 37 and 38, respectively, extending outwardly from the left and right edges of the slide 17, respectively. The actuators 37 and 38, as the slide approaches the left to right ends, respectively, of the box engage arms of the limit switches 34 and 36. The switches either terminate energization of a driving motor to be described subsequently, or constitute reversing switches which cause the slide to terminate travel in one direction and assume travel in the opposite direction.

Continuing with the description of the mechanical structure, the box 1 is sunk into the ground and is provided on its upper surface with resilient members 41 and 42 which are parallel to and secured to the top of box 6 and extend into resilient contact with supports 14 and 16 of the target 18. The purpose of this arrangement is to minimize the entry of water into the mechanism. A generally curved plate 43 extends from one end of the box to the other, being secured to end walls 7 and 8, is disposed over the belt 27 adjacent the top 24 of the slide 17. Member 43 is a curved convex upward and serves to deflect any water or foreign material that may enter through the slot 11 in the top 6 of the box away from the belt 27. The switches 34 and 36, pulleys 29, 31, 32, etc., are disposed beyond the end of the slot 11 and are fully protected by the top of the box 1. Since the slide extends outwardly of the base 19, the curved member 43 extends about to the edge of the base 19 adjacent the members 26 and 27 of the slide. Any water or dirt or related material that enters the box and down from the edge of the member 43 does fall toward the tracks 21 and 22; however, the quantity of material falling is at all times small and since the wheels are located above the base member 2 and are recessed into the side of the member 19, little trouble is encountered as a result of the entry of foreign material into the device.

The box is embedded basically in a gravel environment within the earth and is provided with drain holes such as 44 and 46 so that there is no accumulation of water in the system. The box is situated in the ground such that the upper surface of the flap 41 and 42 are basically level with the surrounding earth and preferably ground is slightly tapered away from the edges of the box so that there is no water running from the surrounding environment into the box and the only water that enters is virtually only that which falls directly on the intersection of flaps 41 and 43.

Secured to the left end of the box as viewed in FIG. 3 is a further enclosure 47 in which is located motor 48 which drives, through a gear box 49, a pulley 51 for driving a belt 52 engaging the pulley 32 in the main box 1. The belt 52 extends through the slot 9 in the end wall of the box 1 as previously described. The enclosure 47 has a top member or cover 51 suitably hinged to the top of the box 47 and gasketed so as to be watertight. The cover 51 may be hinged so that it may be opened to provide access to the motor. The motor 48 may be reversible or it may be provided with a reversing gear in the gear box 49 as desired.

Figure 4:
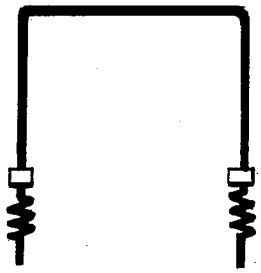
FIGS. 4–9 are side views of various targets that may be employed with the apparatus.
Figure 5:
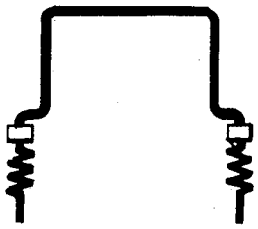
Figure 6:
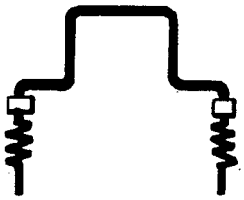
Figure 7:
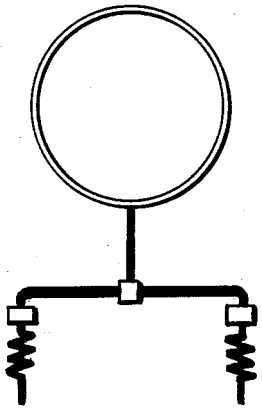
Figure 8:
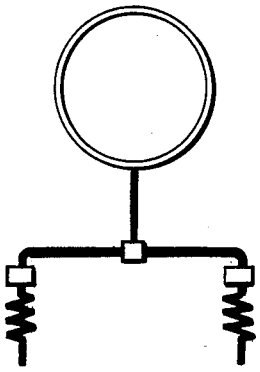
Figure 9:
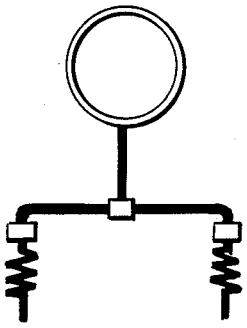

Referring now to FIGS. 4 through 9, there are illustrated various types of targets which may be carried on the support guides or members 14 and 16. It will be noted that each target is terminated at its lower end and as viewed is used in the FIGS. 4 through 9 with springs which are secured to the posts or members 14 and 16 thereby insuring the posts 14 and 16 are isolated from impact of the ball on the target. FIGS. 4 through 6 illustrate simple pass-through targets of different sizes which are used for training individuals of different skill levels. The largest target, FIG. 4, is relatively large compared with the soccer ball perhaps providing four inches around the two sides and the top between the maximum size of the ball and the size of the target. Target 5 is somewhat reduced in the size and target 6 is barely as large as the ball and requires extreme accuracy in passing to cause the ball to pass through. One leg of a target may be disconnected from a support 14 or 16 to permit the target to be rotated. FIGS. 7, 8 and 9 represent hoop targets which may be carried at different heights above the ground and are used to practice chipping, head balls and volley passes. Again, the largest target 7 is for the unskilled player, the target 8 or FIG. 8 is for average skilled, and target 9 is for highly skilled college-level or professional players. Rotation of targets of FIGS. 7–9 is easily effected and provides different approach direction for practice.

FIGS. 1–12 relate to an embodiment of the present invention which is more adapted to permanent installation because of the track, etc. Furthermore, the device is subject to inclement conditions, ice, mud, etc. FIGS. 13–22 illustrate the second preferred embodiment of the invention which, in contrast, to the first embodiment discloses a device including portability and adaptability to most any environment and activity.

Figure 13:
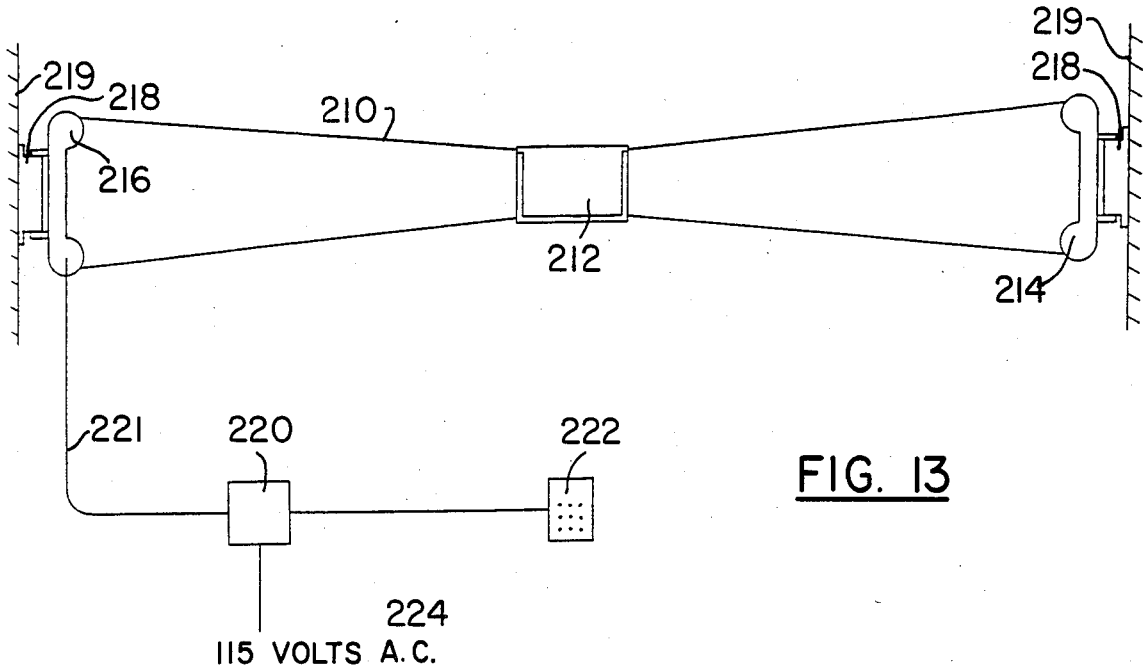
FIG. 13 is a diagrammatic representation of the invention.
Figure 14:
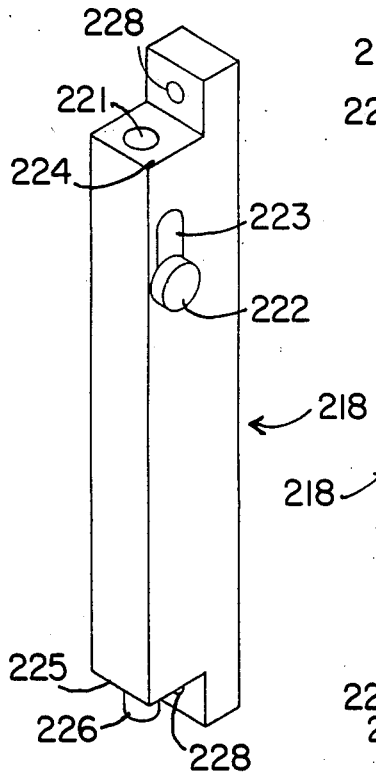
FIG. 14 is a perspective view of the mounting attachments.
Figure 15:
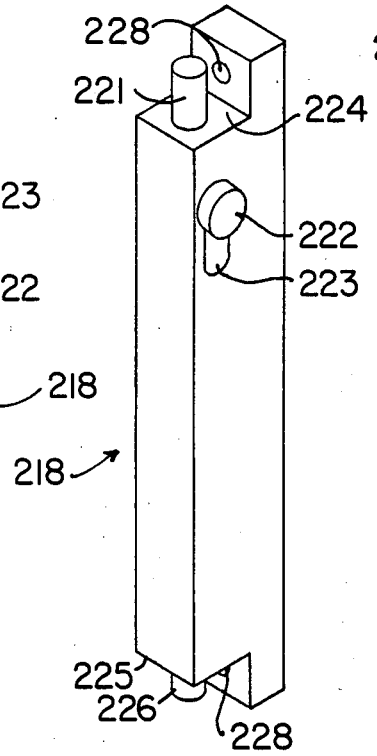
FIG. 15 is another perspective view of the mounting attachments.

Referring now to FIGS. 13 and 14, supports 219 have mounted thereon, mounting attachments 218. Supports 219 permit the mounts 218 to be positioned to prevent interference with the movement of target 212. Goal posts, tethered poles or even walls will suffice. Pulley sets 214 (passive) and 216 (motorized) are then secured to attachments 218. Target 212, connected to cable 210, is mounted between pulley sets 214 and 216 by looping cable 210 around the pulley sets. Motorized pulley set 216 is controlled by electrical switch box 222 connected thereto by conductors 221. The motor is energized by an appropriate electrical source 224 via motor controller 220 which is controlled by a hand-held box 222.

To move target 212, an appropriate control lever or button is positioned to close an electric circuit from the source to motorized pulley set 216 causing the pulley to rotate and drive cable 210. Cable 210 moves linearly and so carries target 212.

Cable 210 can be composed of virtually any lightweight, durable cord material. However, the most preferred material is Delrin. Other materials used in construction of the various components of the invention should also be durable, strong and preferably lightweight. Plastic materials such as Delrin, etc., are quite suitable for its construction.

Mounting attachments 218 incorporate slidable bolts 221 and 226 at each end. Both have similar features and so only those of bolt 221 will be described. Knob 222 is securely affixed to bolt 221 and extends through slot 223 in the side of mount 218. Bolt 221, when retracted, becomes flush with ridge 224. Sliding knob 222 along slot 223 projects bolt 221 above ridge 224 for engaging one of the pulley sets. The bolt 221 may spring biased to the position illustrated in FIG. 15.

To attach mount 218 to support 219, bore holes 228 are provided in the upper and lower extensions from ridges 224 and 225. When bolts 221 and 226 are retracted, mount 218 may be screwed into support 219. Any appropriate means of attachment may be employed, (adhesives, bolts, etc.).

Pulley sets 214 or 216 may be affixed to mounts 218 by sliding connecting members 230 into position on ridges 224 and 225. Sliding bolts 221 and 226 through bores 231 secures the pulley sets to the mounts. Such an arrangement for simple attachment and detachment is desirable for portability and storing the invention in order to prevent weather damage, theft, or vandalism.

Figure 16:
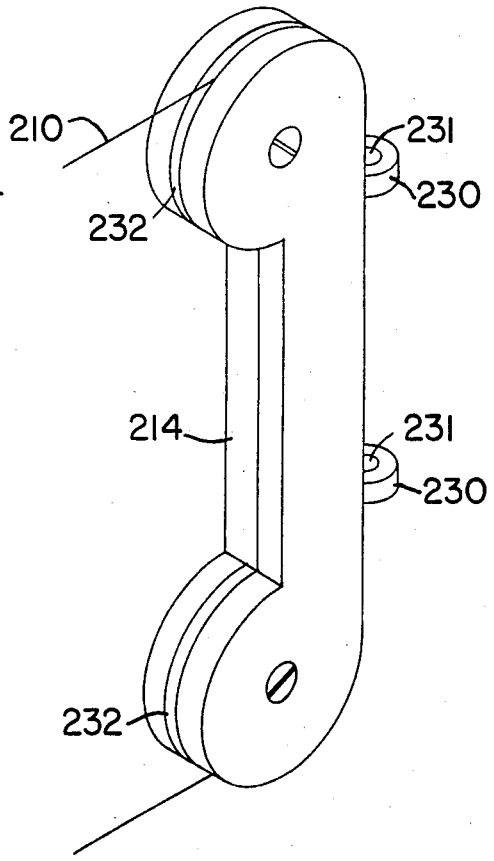
FIG. 16 is a perspective view of the passive pulley structure.
Figure 17:
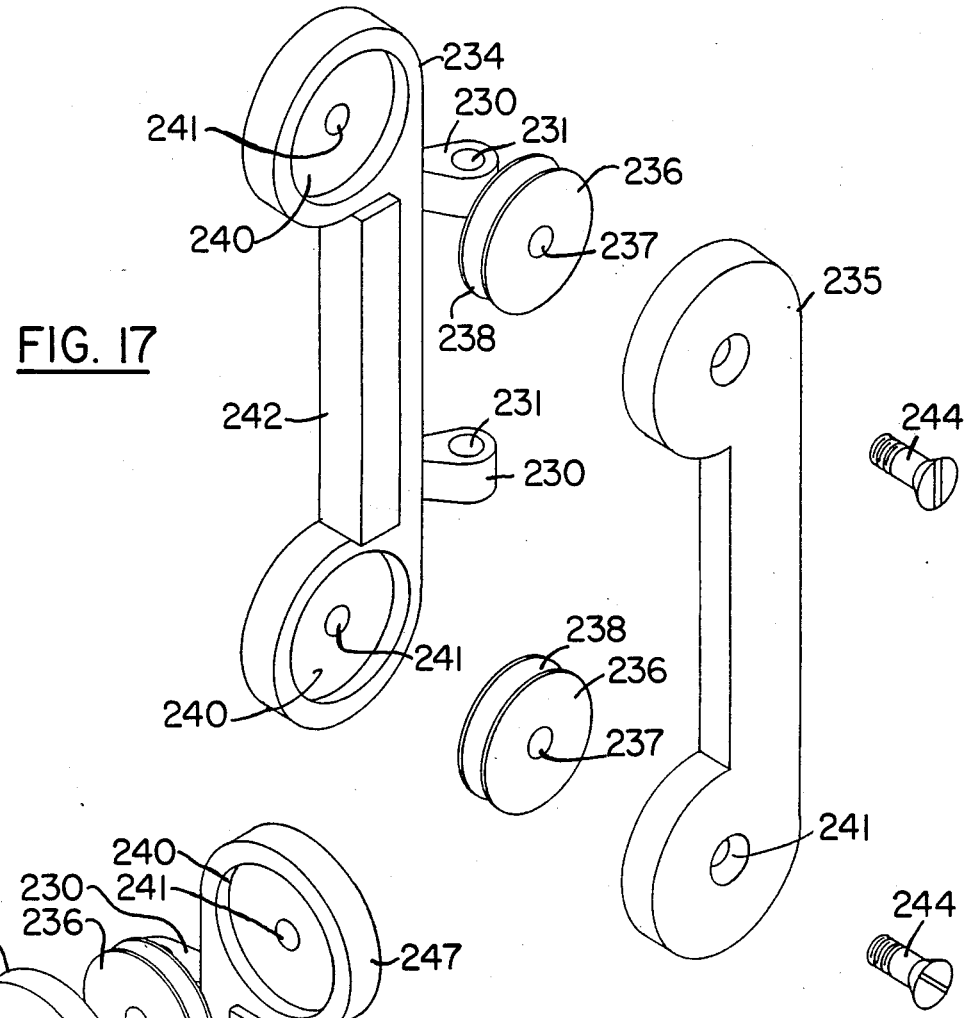
FIG. 17 is an exploded view of the passive pulley structure.

Referring now to FIGS. 16–17, pulley set 214 contains two pulleys 236 separated by an elongated body comprising two elongated members 234 and 235 that are mirror images of one another. The members 234 and 235 terminate at each end in circular recessed bodies 240 in which pulleys 236 are located. A slot 232 is provided between members 234 and 235 by abuttment of projections 242 in the region between the bodies 240. Member 242 prevents complete abuttment of all other portions of 234(*a*) and 234(*b*) resulting in the formation of slot 232 as illustrated in FIG. 16. Cable 210 is positioned by looping it around set 214 in slot 232. Slot 232 is formed along the upper, back and lower portions between elongated members 234 and 235. The two pulleys 236 contained by 234(*a*) and 234 are rotatably mounted in cavities 240 at each end. Bores 237 align with holes 241 whereby bolts 244 pass through holes 241 in 234(*a*), bore 237 in the center of members 240 and out through hole 241 in 235. These bolts are threaded into member 234 and serve as an axis of rotation for the pulleys and hold set 214 together.

Figure 18:
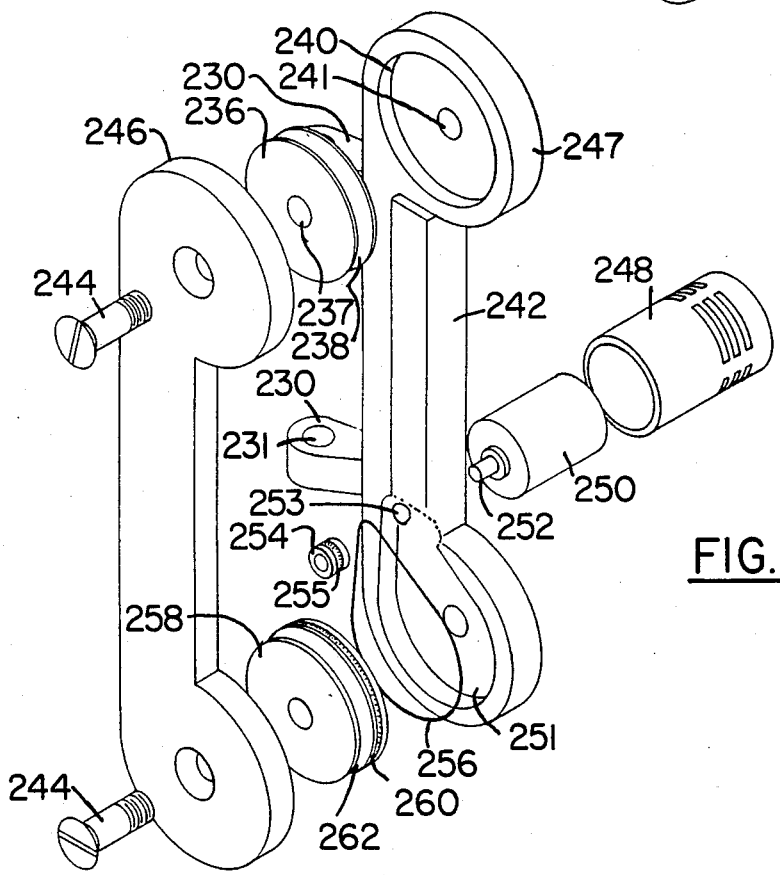
FIG. 18 is an exploded view of the motorized pulley structure.

Motorized pulley, illustrated in FIG. 18, set 216 possesses much the same structure as passive set 214. One passive pulley 236, as those found in set 214, is included at the opposite end of set 216 from an actuating pulley 258. Both pulleys are housed by elongated halves 246(*a*) and 247. The halves 246(*a*) and 247 closely resemble in appearance and assembly their counterparts in passive set 214 except that cavity 251 is triangularly elongated toward the opposite end of the set and includes aperture 253 at the apex of the triangular region. Furthermore, half 247 provides an appropriate mounting (not illustrated) for motor 250 and its protective housing 248.

Motor 250 includes an extension 252 of the motor shaft which protrudes through hole 253 to cavity 251. Drive pulley 254 is securely connected to extension 252 inside cavity 251. Toothed belt 256 engages a toothed slot 255 in drive pulley 254 and toothed slot 260 of actuating pulley 258. Upon rotation of motor 250 and therefore extension 252, drive pulley 254 is rotated. Belt 256 rotates in turn, rotating pulley 258. Pulley 258 imparts linear movement in the direction of rotation to cable 210 by which it is engaged, resulting in the linear movement of target 212.

Figure 19:
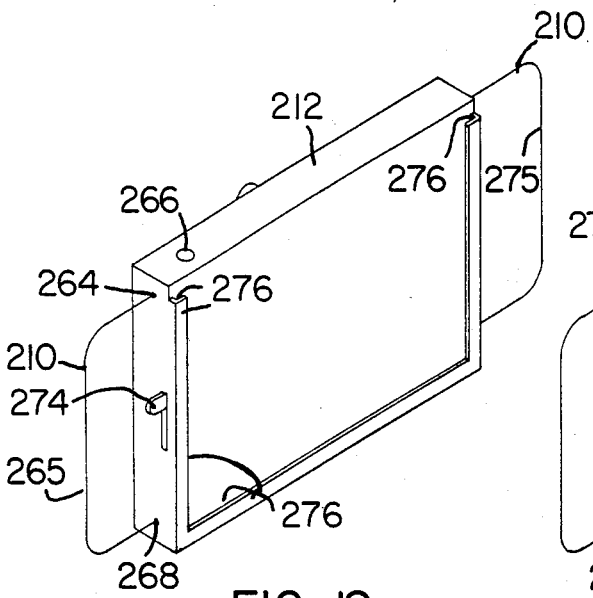
FIG. 19 is a front perspective view of the target structure.
Figure 20:
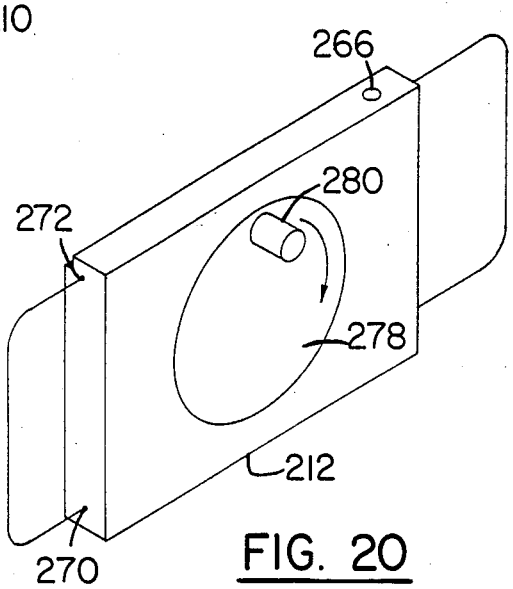
FIG. 20 is a back perspective view of the target structure.

Referring now specifically to FIGS. 19 and 20, Cable 210 forms a loop extending through ports 264, 268, 270 and 272 in target 212. Upper ports 264 and 272 are spaced at a sufficient distance from lower ports 268 and 270 so that target 212 stably traverses the distance between pulley sets 214 and 216. The greater the separation of the cable ports on a given side, the less the probability of target 212 twisting on cable 210. Other visible target features include indicator hole 266, pawl lever 274, radially disposed crank 280 located on spool 278, and peripheral slots 276. Peripheral slots 276 enclose only the lower edge and two sides of the face of target 212. The target face is slipped into this slot so that this particular arrangement lends itself to easy placement of and replacement of the face of the target with faces of desired configuration, size or color. The only limitations on a target face are a proper distribution of weight in order to maintain target balance and a fit either entirely within slots 276 or that it be provided with an appropriate connecting feature compatible with slots 276.

Figure 21:
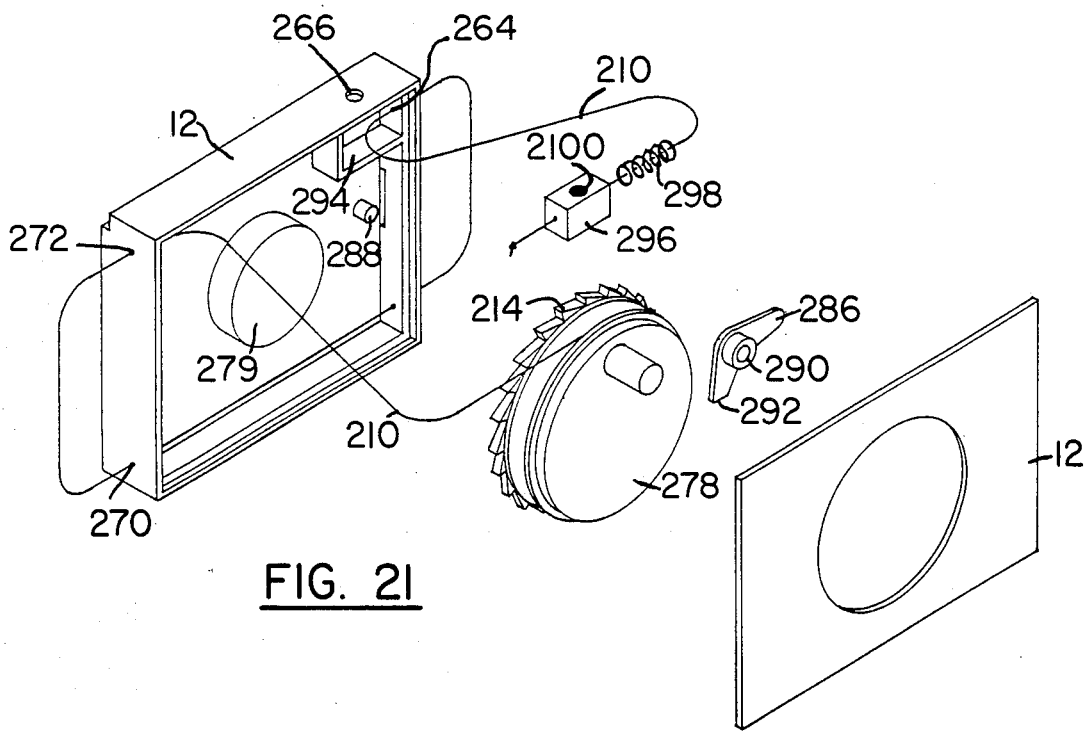
FIG. 21 is an exploded view of the target structure.

As illustrated in FIG. 21, spool 278, secured within target 212 by member 279, incorporates slot 282 for storage and supply of cable 210. One end of cable 210 is secured to and wound around spool 278. Spool 278 may be constructed in any size compatible with target 212. Cable 210 then passes out of the target through port 272, reenters through port 270, passes out of the target through port 268 and reenters through port 264 where it is connected to indicator block 296. The cable thus defines loops 275 and 265 which extend about pulley sets 214 and 216, respectively. Crank 280 positioned on the exterior face of spool 278, extends through the opening provided in front plate 212(*b*) opposite slots 276 on target 212. The interior annular edge of spool 278 is provided with ratchet 284 for engaging pawl 292 to permit tensioning (cranking in direction of arrow in FIG. 20 but preventing unwinding of cable 210. Pawl 292 is rotatably engaged to lug 288, protruding interiorly from target piece 212(*a*), via bore 290. Lever 274 extends from 290 through slot 289 in the side of target 212. When depressed, lever 274 causes pawl 292 to rotate about bore 290 and therefore disengages ratchet 284. Once disengaged, cable 210 may be further elongated by unwinding from spool 278. When returned to its engagement position on ratchet 284, pawl 292 prevents any further elongation of cable 210.

The other cable end loops back into indicator chamber 294 in target 212 via cable port 264 and is secured through indicator block 296. Any appropriate fastening means may be employed to secure cable 210 to block 296 but, as shown, a simple knot will suffice.

Indicator chamber 294, located in the opposite upper corner to port 272 and compatible with port 264, is of appropriate dimensions to secure block 296 and compression spring 298. Cable 210 passes through the elongated aperture of compression spring 298 which is positioned between block 296 and the exterior wall of chamber 294. Compression spring 298 tends to urge block 296 toward the interior wall. Upon sufficient tensioning of cable 210, the compressive forces of spring 298 are overcome and block 296 moves toward the exterior wall of chamber 294.

In order to indicate proper tensioning on cable 210, indicator spot 2100 is provided. As block 296 moves through chamber 294, indicator spot 2100 becomes aligned with indicator hole 266. Once indicator spot 2100 aligns with hole 266, the proper tensioning has been achieved.

The second preferred embodiment (illustrated in FIGS. 13–22) and the first preferred embodiment (illustrated in FIGS. 1–12) require control mechanism. Although the structures of the two preferred embodiments differ, both contemplate a hand-held control console which can be operated manually or preprogrammed to select the run time, stop time and direction of the target.

The features of the control console for the first embodiment is first discussed.

Many of the features are applicable to the control console for the second preferred embodiment but distinguishing aspects do exist and become apparent below.

Both of the apparatuses illustrated contemplate a hand-held control for the device. The device can be preprogrammed to select the run time, stop time and direction.

A typical scenario might be as follows:

The coach selects the following parameters:

Speed Medium—6 Feet/Sec. (approximately)

Run Time—4 Seconds.

Stop Delay—8 Seconds.

In the device of FIGS. 1-9, the target runs for four seconds at 6 feet/second. The target covers twenty-four feet in the direction it was going—unless the target hits the reversing switches 33 or 36, in which case it reverses and completes its four-second run. At the end of the four seconds, the target stops for eight seconds. At this point in time, the coach may do any one or more of the following:

Toggle the reverse switch:

Speed Fast—10 Feet/Sec. (approximately)

Run Time—2 Seconds.

Stop Delay—4 Seconds.

Rotate the target 15 degrees to the left (done manually thus beginning an entirely new passing drill.)

As mentioned, one object of the device as a teaching tool is to teach accuracy. This is accuracy relates to both delivery of the ball to a teammate and to avoid a defender. The coach can use the device to simulate virtually every aspect the movement of both a team member and/or an opposing player. After the coach has programmed the control console, he is free to observe or to go work with another group.

Alternatively, an individual player may wish to come to the field and program the console controller and begin his training session, practicing alone.

The control console provides the variable parameters from which the coach may choose. Thus, the utility of the device is limited only by the coach's imagination.

Figure 10:
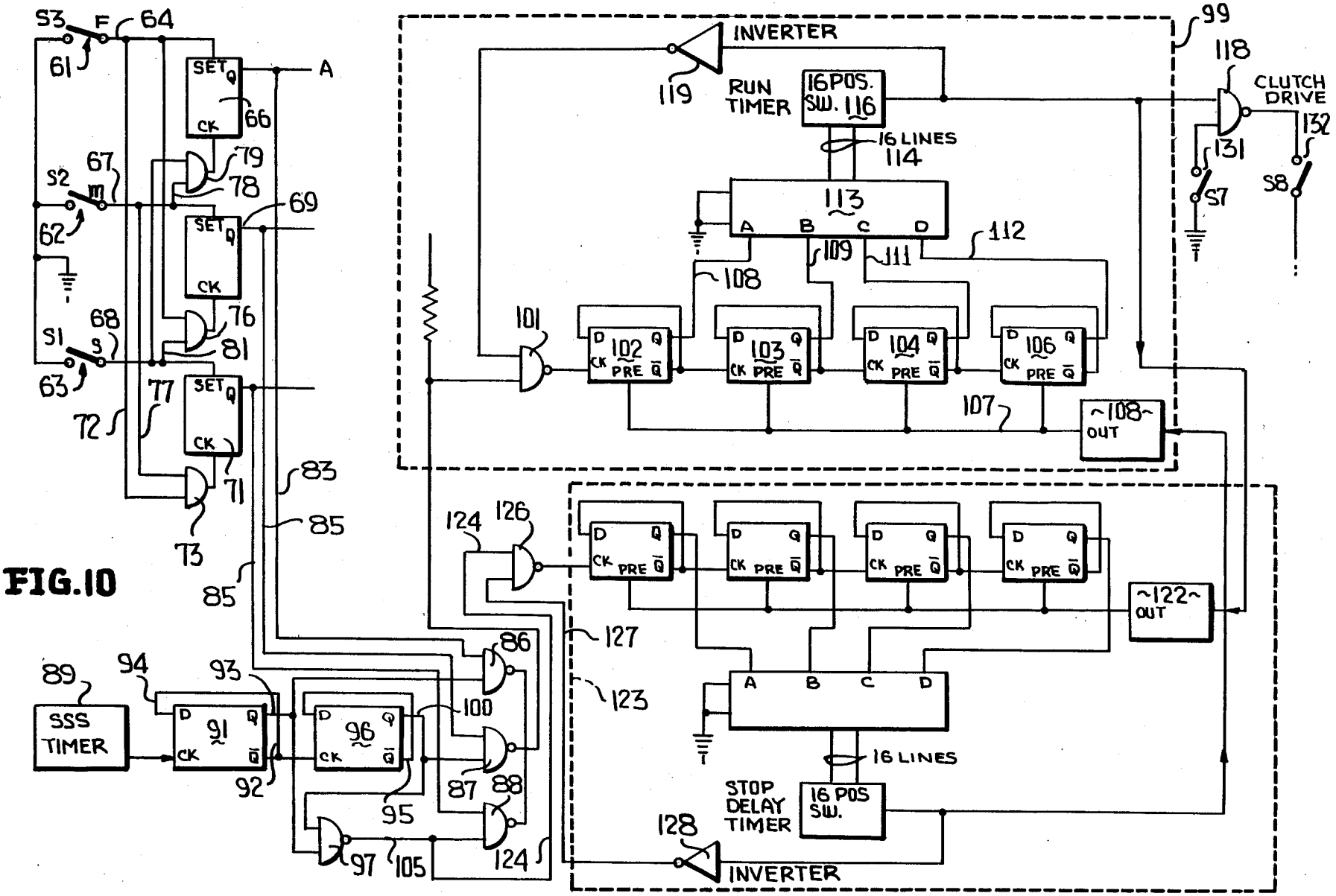
FIG. 10 is a circuit diagram of a run-stop motor control for the circuit.

In order to accomplish these other modes of operation, a control circuit which may be preprogrammed must be provided and one such relatively simple electrical diagram for such controls is illustrated in FIG. 10 of the accompanying drawing.

Referring now specifically to FIG. 10 of the accompanying drawing, the control apparatus is provided with three speed switches; 61 for fast, 62 for medium, and 63 for slow. The left contact as viewed in FIG. 12 of each of the switches 61, 62, 63 is grounded; the movable or right contact the switch 61 being connected via lead 64 to set contact terminal of flip-flop 66. The right contacts of the switches 62 and 63 are connected via leads 67 and 68, respectively, to set the terminals of flip-flops 69 and 71, respectively. Lead 64 is connected via lead 72 to one input terminal of AND gate 76. Lead 67 is connected via a lead 77 to a second input terminal of AND gate 73 and via a lead 78 to an input terminal of AND gate 79. Lead 68 is connected via lead 81 to a second input terminal of AND gate 76. Lead 68 is also connected via lead 82 to a second input to AND gate 79; and gates 73, 76 and 79 have output leads connected to reset terminals of flip-flops 71, 69 and 66, respectively.

In operation, upon closure, for instance, of the slow switch 63, lead 68 is grounded and flip-flop 71 is set to increase the output voltage on its terminal designated C and currently the grounding signal is provided to AND gates 76 and 79 which reduce their outputs to reset flip-flops 69 and so as to lower the voltages on their B and A terminals, respectively. The A-B-C terminals of the flip-flops are connected via leads 83, 84 and 85 to one input each of AND gates 86, 87 and 88, respectively.

A clock 89 provides a clock signal to the CK input of a flip-flop 91 connected as a divide-by-two device having output leads 92 and 93. The output lead 92 (Q) is connected back to second input of the flip-flop 91 whereby to provide the divide-by-two function. The output lead 91 is also connected to CK input of flip-flop 96, another divide-by-two circuit. Lead 93 (Q) of flip-flop 91 is connected to an input of AND gate 86. An output lead 95 (Q) of flip-flop 96 is connected to its D input to provide the divide-by-two function and its Q output on lead 100 is connected as one input to AND gate 87. Leads 93 and 100 are connected to input of a AND gate 97 whereby divide-by-two, four, and six are available on leads 92, 95 and 105, respectively. Thus, switches 61, 62 and 63 select an appropriate gate 86, 87, 88 to determine the pulse rate on a lead 98 which is connected in parallel to the output circuits of all three of the gates 86, 87 and 88.

It should be noted that the flip-flops 66, 69 and 71 are selectively reset by the AND gates 73, 76 and 79. When switch 63 is closed, for instance, leads 64 and 67 are high and the reset inputs CD of these gates are high producing a low output at Q.

The pulses on the lead 98 are applied to a run timer circuit enclosed within dashed-line box generally designated by the referenced numeral 99. The lead 98 is connected to one input of a AND gate 101, the output of which is connected to flip-flop 102 of a series of flip-flops including flip-flops 103, 104 and 106, each connected as a divide-by-two circuit. A preset input of each of these circuits is connected to a common fuse 107 receiving an output signal at an appropriate time from a one-shot multivibrator.

The Q outputs of circuits 102, 103, 104 and 106 are connected via leads 108, 109, 111, and 112, respectively, to inputs of a hexadecimal to decimal converter 113. The converter 113 is provided with 16 output leads 114, any one of which may be selected by a switch 116 to determine the time interval during which the motor is energized. Specifically, converter 113 provides a low output from the selected lead 114 until the timer times out, i.e., high voltage appears over the selected lead 114. At this time, the lead 117 goes high and negative AND gate 118 is blocked (switch 131 being open) removing energization from a drive clutch 138 (see FIG. 11) from the motor to the belt 52, specifically a clutch in the gear box 49.

When the lead 117 goes high, inverter 119 opens gate 101 and the pulse train to the run time 99 is discontinued. The high signal on lead 117 is transmitted via lead 121 to one-shot vibrator 122 which resets the timing circuit of a stop delay timer enclosed within dashed lines 123.

Input pulses to delay timer 123 are from the output lead of gate 97 thereby by-passing the selectively actuated gate 88. Such output (every sixth pulse of the clock 89) is conducted via lead 24 to gate 126 whereby delay timer 123 receives pulses whenever lead 124 and lead 127 from inverter 128 are high.

The delay timer has the same internal circuitry as the run timer and the output on its output lead 129 is low during operation of the delay timer. When the circuit times out, the voltage on lead 129 goes high removing the gating pulse from the lead 127 and applying a reset to the one-shot 108 which resets the run timer and lowers the voltage on lead 117 so that the gate 101 will again pass negative pulses on lead 98.

The run timer-delay timer provides a stop and go type of operation, running for an interval and stopping for an interval. If switch 131 is closed, a second input to gate 108 is grounded and lead 120 to the clutch solenoid remains high and the motor runs without interruption. A switch 132 may be inserted in lead 120 to stop the motor without turning off the device. This switch may be used when changing setting of the timers or changing targets, etc.

A forward-reverse arrangement is provided by a one-shot vibrator 134 and a divide-by-two circuit 136. A switch 137, when closed, grounds the input lead to the one-shot 134 and causes it to pulse. The pulse is applied to the clock (CK) input of the circuit 136 and matches the output control voltage between the Q and Q outputs. A second closing of the switch 137 reverses the signal on the outputs of 136 and reverses the direction of running of the motor.

Figure 11:
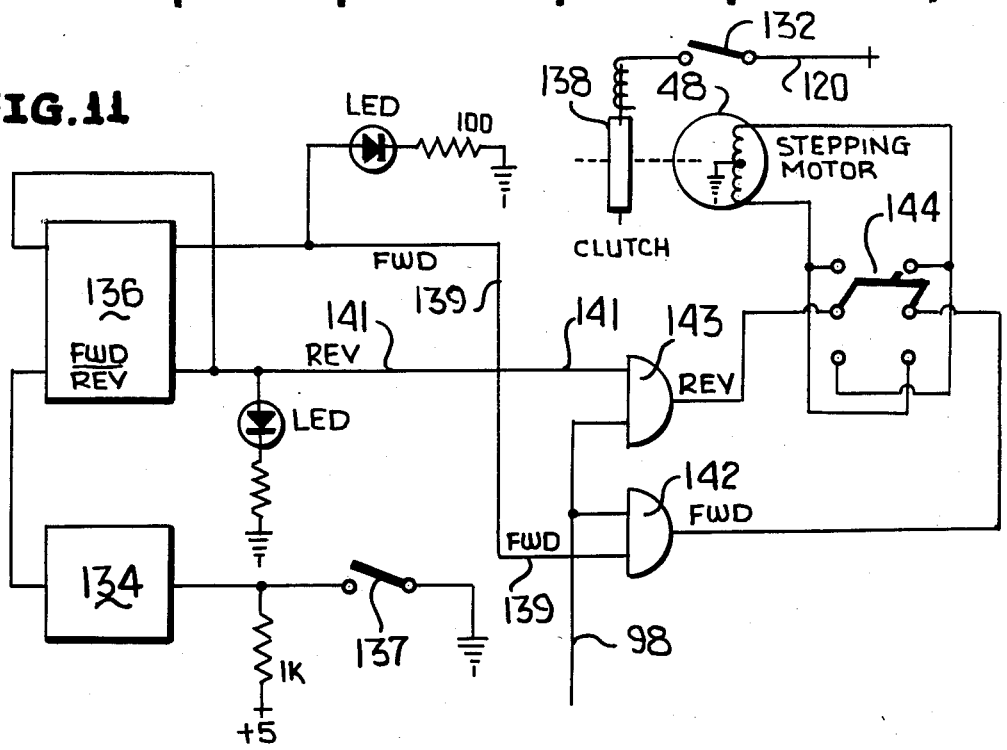
FIG. 11 is a circuit diagram of the motor and forward reverse control therefor.

The motor drive circuit is illustrated in FIG. 11. This circuit includes an input from lead 98 of FIG. 10 applied to AND gates 139 and 141 which also receive input on leads 142 and 143 from the forward and reverse of flip-flops 136. A reversing switch 144 represents the reversing switches 34 and 36 of FIG. 1.

The pulses on lead 98 are gated via one of gates 141 or 142 and switch 144 to stopping motor 48 to produce rotation of the drive pulley 51 of FIG. 3. As previously indicated, the system may be put into a neutral or idle state by deactuating clutch 138.

Figure 12:
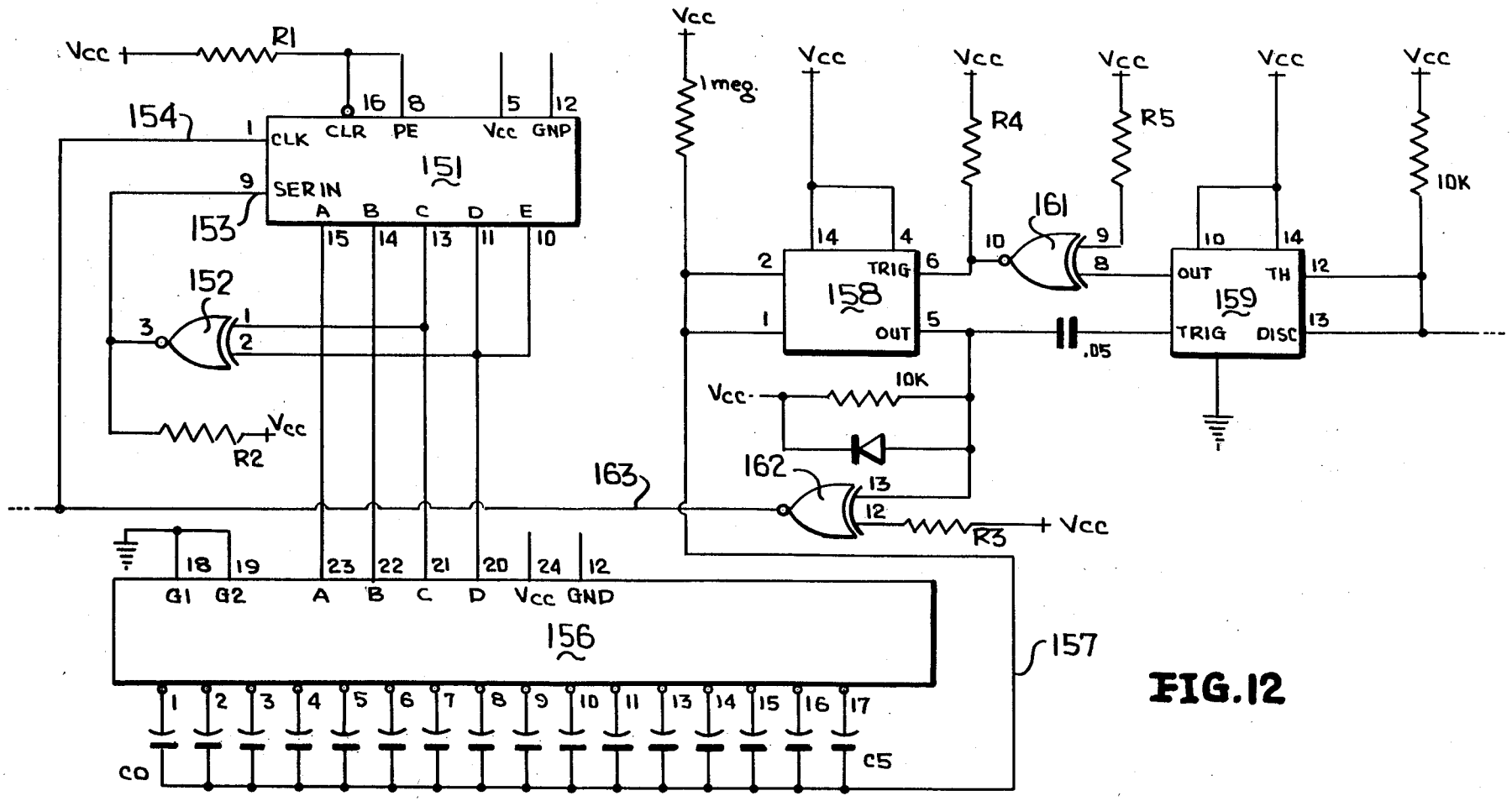
FIG. 12 is a circuit diagram of a random time generator for varying the speed of the motor on a random basis.

In some instances, it may be desirable to replace the constant speed of the motor with a random speed capability. Referring specifically to FIG. 12, a 7496 shift register 151 has its C, D and E outputs connected via exclusive or gate 152 to its serial input terminal 153. This connection is known to produce a relatively random output on output leads A–E. The register 151 is clocked via lead 154 which derives its pulses in a manner to be described.

The output terminals A–E of the register 151 are connected to the A through D input terminals of a 74154 shift register connected as a parallel input multiplier 156 having 17 output leads. Note that the output terminals D and E of register 151 are connected together.

Each combination of the four input signals to device 156 selects a different output lead 1–17 to change a different value capacitor $C_0$ to $C_{15}$. The aggregate voltage across the capacitors $C_0$ to $C_{15}$ appears on a lead 157 which quite obviously is in a state of continuous and unpredictable variation.

The randomness of the operation of the circuit is further enhanced by the use of voltage controlled oscillators (IC 556) 158 and 159 connected in a ring fashion. The VCO 158 is controlled by the varying voltage on lead 157. The output of VCO 158 is applied to the trigger input of VCO 159, the output of which is connected via exclusive OR gate 161 to the trigger input of VCO 158. The output of VCO 158 is connected via exclusive OR gate 162 to a lead 163 which serves as the output of the circuit and the input to register 151.

The ring arrangement of VCO's introduces additional randomness into the circuit as a result of the random voltage on lead 157 and the random trigger from gate 161.

The lead 163 may be applied to the circuit of FIG. 11 along with lead 98 through an exclusive OR gate to control the motor 48.

The circuits of FIGS. 10–12 are illustrative only of the various types of circuits which may be employed to provide the various training functions identified herein. A multitude of different circuits may be employed without affecting the basic concept of the invention.

Figure 22:
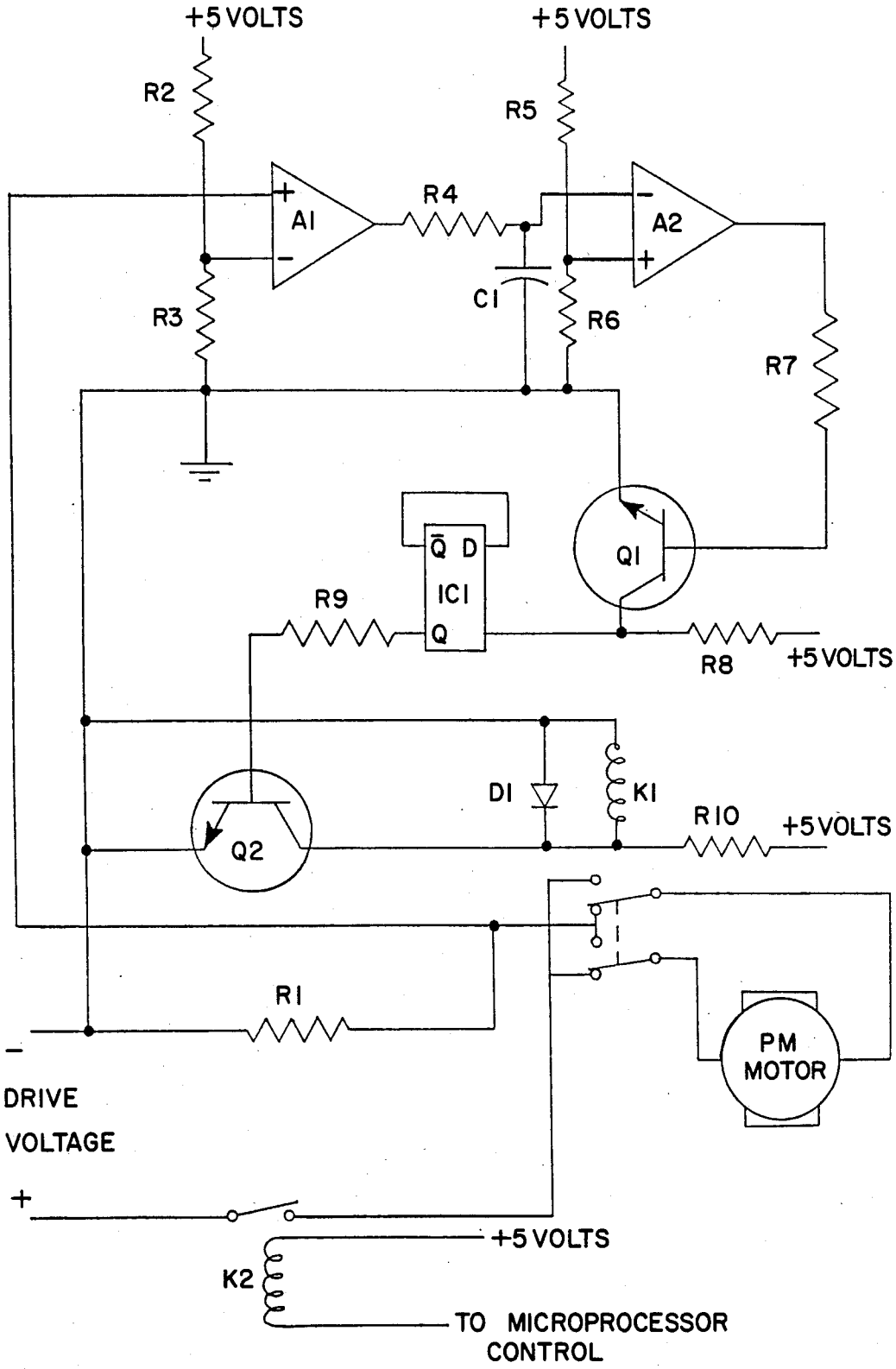
FIG. 22 is a circuit diagram of a motor circuit employed with the embodiment of FIGS. 13–21.

The apparatus of FIGS. 13–21 utilizes a novel motor reversing circuit illustrated in FIG. 22. It will be noted in FIG. 13 that the spacing between the cable receiving apertures in target 212 have a lesser spacing therebetween than the spacing between the regions on the periphery of the pulleys of each pulley set remote from one another. Thus, as the target approaches a pulley set, the lengths of cable exiting such pulley set are pulled toward one another. Such action loads the motor and increases its current consumption. This fact is employed in the automatic reversing circuit of FIG. 22.

It is important to note, that by triggering the reversing feature by this method, the passive or slave pulley does not require any connection to the console. The action loads exerted on the motor can be detected by the circuit even when the target is at a remote point on the cable.

The ease of assembly and disassembly and the simplicity of this embodiment more readily lends itself to teaching and the use by an individual or amateur athlete.

Referring now specifically to FIG. 22 of the accompanying drawings, a resistive voltage divide $R_2R_3$ establishes a threshold signal at the negative input to an amplifier A1. The resistor R1 has the motor current passing through it and the voltage developed thereacross is applied to the positive input to amplifier A. When this latter voltage exceeds the voltage on the negative terminal, an output is developed, and the capacitor C1 is charged through R4. At the point at which the voltage across C1 exceeds the voltage threshhold developed by the R5, R6 resistor divider, the output of A2 goes negative turning off transistor Q1, thus clocking flip-flop FF1. Thus, the R4, C1 combination acts as an integrator to avoid false trigger due to noise. When FF1 toggles, it changes the state of transistor Q2 from on to off, or off to on, thus reversing the state of relay K1. Relay K1 is the motor reversing relay and the motor changes direction upon change of energization of relay K1. The circuit functions no matter in which direction the motor initially starts its travel.

It should be emphasized that the device is quite portable; in its present configuration will fit in a suitcase $18'' \times 13\frac{1}{2}'' \times 6''$ and weighs less than 10 pounds. The size and weight of this device are directly affected by the simplicity of the device which performs all of the drive functions by a motor located at one end of the device; the slave end comprising only one or two pulleys and a support. The controlling system is so small as to set it in the hand, and adds practically no weight or size. Further, the reverse control adds virtually no weight or bulk, not requiring mechanical or electrical switches, sensors or other types of add ons, it being only necessary for the controlling system to sense changes in the motor load current.

Another important feature of this invention is that it is capable, as indicated above, of providing a quantative measure of performance.

Once given the above disclosure, many other features, modifications, and improvements will become apparent to the skilled artisan. Such other modifications, features and improvements are, therefore considered a part of this invention, the scope of which is to be determined by the following claims:

I claim:

1. A device for training and increasing perceptual and perceptual-motor skills comprising:

a target means;

cable means having a first end and a second end for supporting said target means;

electrically actuated means for moving said target means along said cable means, said moving means including means to sense change in electrical load;

means for supporting said cable means wherein said target means is able to move along the cable means between said ends when driven by said moving means, means for significantly changing the electrical load on said moving means as said target means moves along the cable means toward one of said ends, circuit means for reversing said moving means said circuit means being responsive to significant electrical load changes on the moving means.

2. The device according to claim 1 further comprising:

at least two pulley means spaced apart at a predetermined distance having said target means positioned therebetween and having said cable means looped around each; and means for supporting said pulley means whereby said target means moves along said cable means between said pulley means when said cable means is driven by said means for moving.

3. The device according to claim 1 wherein said cable means is a cable which has a first and a second end; and further comprising means for securing said first cable end to said target and means for securing said second cable end to said target wherein said cable means forms a first and a second loop extending from said target means;

said supporting means being a first and a second pulley means whereby said target means is positioned therebetween and said cable loops engage said first and second pulley means;

where said moving means is a motor means and is connected to said first pulley means thereby imparting linear movement to said target;

an electrical control means containing said circuit means and for controlling said motor and target direction of travel.

4. The device according to claim 3 further comprising:

a first and second pulley for supporting said cable and over which said first and second loops are engaged, respectively.

5. The device according to claim 4 further comprising:

a notched belt, a drive gear extending from said motor means and complementary to said belt, at least one notched gear incorporated on said first pulley means whereby rotational movement of said motor is transferred to said belt which rotates said pulley means which, in turn, imparts linear movement to said cable means.

6. The device according to claim 5 wherein said pulley means are a first, and a second dual pulley set; each of said pulley sets having a housing with entrance and exit slots for said cable means.

7. The device according to claim 6 further comprising two pulleys, an elongated slotted member and complementary to said cable separating said pulleys;

means for fastening said pulley set to said support means, whereby said cable enters the entrance slot, engages said first pulley, extends through said slotted member, engages said second pulley, and exits from the exit slot.

8. The device according to claim 7 further comprising at least one bored, extending connecting member, a mountable member having a cavity complementary with said connecting member, a retractable bolt contained by said mountable member, complementary with said bore for lockedly engaging said connecting member to said mountable member and, therefore, said pulley housing.

9. A device according to claim 1 where said supporting means comprises first and second spaced apart pulleys with the target means positioned therebetween, said cable means looping over said pulleys in a manner to establish two spaced apart lengths of cable means where each length is connected to said target means and movement of said target means toward and in close proximity to one of said pulleys significantly changes the electrical load on the moving means.

10. The device according to claim 9 further comprising:

operator control means connected to said control means whereby the operator may reverse target direction, increase or decrease target velocity, and stop or start said target means.

11. The device according to claim 9 further comprising:

an electronic control means containing said circuit means which automatically reverses the target direction when actuated by increasing system load caused by the target approaching either of said pulleys whereby said cable means loop diverges from said target means to said pulley.

12. The device according to claim 9 wherein said cable means is a cable having a first and second end and further comprising means for securing said first cable end to said target, means for compressing said securing means to abut said target, whereby upon tensioning said cable, the force on the securing means can overcome the compressing force.

13. The device according to claim 12 further comprising a housing for slidably securing said securing means within said target, an opening in said housing whereby said indicating means is complementary with said opening when proper tension is applied to said cable means.

14. The device according to claim 13 further comprising a visible spot as said indicating means which aligns with said opening upon proper tensioning of the cable.

15. The device according to claim 14 further comprising a poppet as said indicating means which aligns with said opening, engaging said opening upon proper tensioning at the cable.

16. The device according to claim 12 further comprising a spool attached to said second cable end and contained by said target.

17. The device according to claim 16 further comprising a releasable pawl and complementary ratchet teeth on said spool whereby the spool may rotate freely in only one direction.

18. The device according to claim 17 further comprising a release lever biasly engaging said ratchet teeth.

19. A device for training and increasing perceptual and perceptual-motor skills, comprising:

(a) target means;

(b) cable means for supporting said target means, said cable means being extendable between a first and second preselected points and defining at least two lengths of cabling extending generally between said first and second preselected points and separated by a preselected distance;

(c) means for moving said target means in a generally linear manner corresponding to said cable means between said first and second points;

(d) means for changing the distance between said lengths of cabling which results in a corresponding change in the load on said moving means; and (e) circuit means for controlling said moving means to change the direction of movement of said target means along said cable means, said circuit means being responsive to significant load changes on said moving means resulting from changes in the distance between said lengths of cabling as the target moves therealong.

20. A device according to claim 19 further comprising means for supporting said cable means, said supporting means including pulley means over which said cable means is looped.

21. A device according to claim 19 where said cable means is an elongated cable and further comprising supporting means for said cable, said supporting means including two pulleys, each pulley having an annular groove to said cable wherein the distance between the lengths of cabling corresponds to the distance between the pulleys.

22. A device according to claim 19 where said cable means lengths are generally parallel.

23. A portable apparatus for providing a moving target and support therefor, comprising:

a cable, a target support on said cable support member, pulley means for supporting said cable and being supported on said support member, where said cable imparts a tension on said pulley means, which varies depending on the position of the target support relative to the pulley means, a bidirectional motor for driving the cable, means for controlling energization of said motor, said control means including means for changing the motor's direction, said control means further including means for sensing the tension on said pulley means and means for changing the direction of said motor when the tension varies from a preselected tension.

24. An apparatus according to claim 23 including means for reversing the direction in which said one of said pulley means is driven, said means for controlling includes means for sensing tension in said cable and means for reversing the driven direction of said one of said pulleys upon tension in said cable exceeding a preset tension.

25. An apparatus according to claim 24 wherein said means for controlling includes means for at will setting the tension in said cable at which reversal of said direction of driving occurs.

26. An apparatus according to claim 25 wherein said means for controlling energization includes a portable power supply.

* * * * *